United States Patent [19]

Karinthi

[11] Patent Number: 5,030,278

[45] Date of Patent: Jul. 9, 1991

[54] PROCESS OF RESTRUCTURING A GROUP OF FINELY DIVIDED PARTICLES

[75] Inventor: Pierre Karinthi, Jouy En Josas, France

[73] Assignee: L'Air Liquide, Societe Anonyme pour l'Etude et l'Exploitation des Procedes, Paris, France

[21] Appl. No.: 507,884

[22] Filed: Apr. 12, 1990

[51] Int. Cl.[5] ..... B22F 9/00

[52] U.S. Cl. ..... 75/252; 75/254; 75/331; 75/352; 75/354

[58] Field of Search ..... 75/252, 254, 331, 354, 75/352

[56] References Cited

U.S. PATENT DOCUMENTS

| | | | |
|---|---|---|---|
| 4,562,040 | 12/1985 | Yamada et al. | 75/254 |
| 4,592,781 | 6/1986 | Cheney et al. | 75/331 |
| 4,619,699 | 10/1986 | Petkovic-Luton et al. | 75/252 |
| 4,627,959 | 12/1986 | Gilman et al. | 75/352 |
| 4,824,478 | 4/1989 | Roberts et al. | 75/341 |

FOREIGN PATENT DOCUMENTS

| | | |
|---|---|---|
| 0015151 | 9/1980 | European Pat. Off. . |
| 0245744 | 11/1987 | European Pat. Off. . |
| 1404993 | 10/1968 | Fed. Rep. of Germany . |

*Primary Examiner*—Upendra Roy

*Attorney, Agent, or Firm*—Young & Thompson

[57] ABSTRACT

Process of restructuring a group of finely divided particles, of granulometries lower than 100 microns, wherein the particles to be restructured are placed in a bath of cryogenic liquid which is inert with respect to the particles, the operation of restructuring is allowed to proceed after which the cryogenic liquid is withdrawn for example by evaporation. Applications to the production of metallic alloys, special polymers, paints, inks, carbon black, special ceramics and pharmaceutical or food products.

18 Claims, No Drawings

PROCESS OF RESTRUCTURING A GROUP OF FINELY DIVIDED PARTICLES

BACKGROUND OF INVENTION (1) Field of the Invention

The present invention concerns the restructuring of finely divided powders, of a granulometry lower than 100 microns (μm), for example lower than 10 μm.

(2) Description of Prior Art

It is known that it is generally very difficult to mix finely divided powders of different types, whether metallic or not; it is even more difficult to sort powders of different granulometries whenever they are smaller than 100 microns. For granulometries smaller than 1 micron, the particles agglomerate or align themselves under the effect of surface tension forces or electrical forces: sorting, mixture and use of the powder in grain size therefore become impossible.

SUMMARY OF INVENTION

The present invention aims at a process of restructuring powders or finely divided particulate materials, of granulometries smaller than 100 microns, which enables to carry out the usual operations of restructuring, namely the supplying of finely divided powder in homogeneous form, as intimate mixtures of powders or of a separation and sorting of powders of different granulometry and/or types.

According to the invention, the particulate materials to be restructured are placed in a bath of a cryogenic liquid which is inert with respect to said particulate materials, the operation of restructuring per se is carried out, after which the cryogenic liquid is removed, for example by evaporation.

It has indeed been observed that when placed in a cryogenic liquid, such as nitrogen, argon, helium, $CO_2$, $N_2O$, $CH_4$ or in a cryoscopic liquid, such as a mixture of dry ice and acetone, ether or alcohol, the powders are separated in granular form in view of the very low surface tension, which greatly reduces the risk of flocculation. Moreover, most of these liquids are inert towards the powdery products used and their removal to recover dry and homogeneous powders is very easy.

It has also been observed that for the same granulometry, the decanting speed is 10 times faster than in the case of a liquid such as water, in view of the low viscosity of the pure cryogenic liquids.

These observations enable to use cryogenic liquids to treat fine powders in different manners, out of range of the usual means.

WORKING EXAMPLES:

1—SEPARATION

The speed of settling being high, metallic particles of 1 micron can easily be separated from particles of 0.1 micron, by placing them in a cryogenic liquid such as liquid nitrogen. The first particles settle at a rate of 15 mm per hour, the second ones at the rate of 0.15 mm per hour: in water, neither of the two granulometries settle.

In practice, the phenomenon can be accelerated by centrifugation.

Moreover, because the granular particles are not agglomerated, it is possible to find filters which allow the passage of 0.01 micron particles but stop the 0.1 micron particles.

2—HOMOGENISATION

A powder consisting of very finely divided particles is dispersed in a cryoscopic liquid, followed by stirring, settling and extracting of the liquid, for example by natural or forced evaporation. The powder collected is free of aggregates and is perfectly fluid, which enables it to be exploited, for example after filtration, without risks of plugging or coalescing, in particular in processes of projection.

3—MIXTURES

Placed in a cryogenic or cryoscopic liquid, the particles are separated and powders of different types can easily be homogeneously and intimately mixed.

It is thus easy to prepare a very intimate mixture of metallic and/or non-metallic particles in a mixture of acetone and dry ice at −86° C. Particularly interesting results have been obtained for a very intimate mixture of zirconia ($ZrO_2$) of 0.1 μm granulometry with carbon black of 0.2 μm granulometry, of silica of 0.2 μm granulometry with carbon black of 0.2 μm granulometry, of silica and zirconia as well as alumina and zirconia, both having a granulometry of 0.2 μm. These homogeneous powdery mixtures are particularly adapted for obtaining ceramic materials, by extrusion or injection moulding, which are substantially free of dislocations after fritting.

Intimate mixtures of particles of alumina and zirconia of a granulometry lower than 0.2 μm have been prepared in liquid nitrogen, the homogenisation of the suspension being accelerated by the application of weak ultrasonic waves.

The process according to the invention also finds application with polymeric compounds, such as polyethylene or polystyrene: placed in a cryogenic bath which is inert towards polymeric particles, the latter present a higher number of available free radicals than in a suspension medium at room temperature, which promotes stable reassociations when the cryogenic liquid is evaporated.

As an example of other application, the mixture of such polymeric particles with mineral or organic pigments may also be mentioned.

4—APPLICATIONS

When the cryogenic liquid is progressively evaporated, the density of the suspension increases. If a thick suspension is placed on a hot support (with respect to the cryogenic liquid), the suspension does not contact the support as long as some liquid remains, following the phenomenon of calefaction. This phenomenon can be used to distribute powder on a surface support in a regular and homogeneous manner.

The fields of application of this process are wide and in particular, the following preparations can be mentioned:

metallic powders, mechanical alloys,
special polymers,
paints,
inks, carbon black,
special ceramics,
pharmacy,
food.

In these last two mentioned fields, the mixtures of particles are carried out more rapidly and more intimately than in aqueous suspensions which require the use of surfactants followed by an extended drying which is costly in energy.

I claim:

1. A process of separating particles having a granulometry in a selected range from a bulk of particles having different granulometries, comprising the steps of:

placing the bulk of particles in a bath of a cryogenic or cryoscopic liquid which is inert with respect to the particles;

causing the particles to settle by gravity in the bath;

removing the settled particles with part of the liquid, sequentially with respect to their granulometry; and causing the liquid to evaporate thereby to collect dry non-agglomerated particles having a granulometry in said selected range.

2. The process of claim 1, wherein said selected granulometry range is below 100 microns.

3. The process of claim 1, further comprising the step of filtering or screening the collected particles.

4. The process of claim 1, wherein the liquid is selected from the group consisting of nitrogen, argon, helium, carbon dioxide, nitrogen monoxide, low-boiling hydrocarbons, and mixtures of dry ice with acetone, alcohol or ether.

5. The process of claim 2, wherein said selected granulometry range is below 1 micron.

6. A process of obtaining a powder of individual finely divided particles substantially free from agglomerated particles, which comprises the step of:

dispersing a raw bulk of said particles in a bath of a cryogenic or cryoscopic liquid which is inert with respect to the particles;

stirring the bath;

allowing the particles in the bath to settle by gravity and, causing the liquid to evaporate thereby to collect a dry powder of non-agglomerated particles.

7. The process of claim 6, further comprising the step of filtering or screening the collected particles.

8. The process of claim 6, wherein said selected granulometry range is below 1 micron.

9. The process of claim 6, wherein the liquid is selected from the group consisting of nitrogen, argon, helium, carbon dioxide, nitrogen monoxide, low-boiling hydrocarbons, and mixtures of dry ice with acetone, alcohol or ether.

10. A process of intimately mixing together at least two different classes of finely divided particles, which comprises the steps of:

placing the particles to be mixed in suspension in a bath of a cryogenic or cryoscopic liquid which is inert with respect to the particles;

homogenizing the suspension in the bath, and causing the liquid to evaporate thereby to collect a dry homogeneous powdery mixture.

11. The process of claim 10, wherein the particles of one said class have a granulometry different from the granulometry of the particles of another said class.

12. The process of claim 11, wherein said particles to be mixed have a granulometry below 1 micron.

13. The process of claim 11, wherein the particles of one said class are metallic particles and the particles of another said class are non-metallic particles.

14. The process of claim 11, wherein the particles of all said classes are metal oxide particles.

15. The process of claim 11, wherein the particles of one said class are polymeric particles.

16. The process of claim 11, and shaping the collected dry homogeneous powdery mixture by extrusion or injection molding.

17. The process of claim 11, wherein the liquid is selected from the group consisting of nitrogen, argon, helium, carbon dioxide, nitrogen monoxide, low-boiling hydrocarbons, and mixtures of dry ice with acetone, alcohol or ether.

18. The process of claim 15, wherein the particles of another said class are pigment particles.

* * * * *